US011473273B2

(12) United States Patent
Parzynski, Jr. et al.

(10) Patent No.: US 11,473,273 B2
(45) Date of Patent: Oct. 18, 2022

(54) TOOL BIT HAVING A CYLINDRICAL PROFILE AND BLADE ASSEMBLY

(71) Applicant: Caterpillar Inc., Peoria, IL (US)

(72) Inventors: David Bruno Parzynski, Jr., Peoria, IL (US); Thomas Marshall Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 64 days.

(21) Appl. No.: 15/952,844

(22) Filed: Apr. 13, 2018

(65) Prior Publication Data

US 2019/0316326 A1 Oct. 17, 2019

(51) Int. Cl.
*E02F 9/28* (2006.01)
*E02F 3/815* (2006.01)

(52) U.S. Cl.
CPC ..... *E02F 9/2858* (2013.01); *E02F 3/815* (2013.01); *E02F 3/8152* (2013.01); *E02F 9/2833* (2013.01)

(58) Field of Classification Search
CPC ..... E02F 9/2808; E02F 9/2816; E02F 9/2858; E02F 3/815; E02F 3/8152; E02F 9/2833
USPC ..... 172/701.1, 701.3, 777
See application file for complete search history.

(56) References Cited

U.S. PATENT DOCUMENTS 2,305,653 A * 12/1942 Ward ..... E02F 9/2825 37/453
3,585,741 A 6/1971 Heusler
4,084,856 A * 4/1978 Emmerich et al. ... E21C 35/197 175/354
4,753,299 A * 6/1988 Meyers ..... E02F 9/2825 172/701.3
4,784,517 A 11/1988 Sandvik
D308,684 S * 6/1990 Meyers ..... D15/28
5,496,131 A * 3/1996 Tiback ..... B28D 1/188 299/40.1
5,520,444 A * 5/1996 Kosobrodov et al. ..... E21C 35/183 299/106
5,799,741 A * 9/1998 Kosobrodov et al. ..... E21B 10/006 175/350
5,833,323 A * 11/1998 Massa ..... E21C 35/193 299/102
5,947,209 A * 9/1999 Halford et al. ..... A01B 15/025 172/714
2003/0188463 A1 10/2003 Manaway et al.
2016/0024917 A1 1/2016 Hall et al.
(Continued)

FOREIGN PATENT DOCUMENTS

CN 103052756 4/2013
EP 2291565 3/2011
WO 2012018295 2/2012

OTHER PUBLICATIONS

Caterpillar Inc., "Cat® Buckets and Ground Engaging Tools for Medium Wheel Loaders 950-980", Published May 2014, Wear Button on p. 11, published and circulated in US by Caterpillar Inc.

*Primary Examiner* — Thomas B Will
*Assistant Examiner* — Joel F. Mitchell
(74) *Attorney, Agent, or Firm* — Law Office of Kurt J. Fugman LLC

(57) ABSTRACT

A tool bit comprises a shank portion including a cylindrical configuration defining a longitudinal axis, a radial direction, and a circumferential direction, and a working portion
(Continued)

including a cylindrical configuration that is concentric with the shank portion and a flat bottom surface.

18 Claims, 10 Drawing Sheets

(56) References Cited

U.S. PATENT DOCUMENTS

2017/0342829 A1* 11/2017 de Sousa et al. ..... E21B 3/02

* cited by examiner

TOOL BIT HAVING A CYLINDRICAL PROFILE AND BLADE ASSEMBLY

TECHNICAL FIELD

The present disclosure relates to cast serrated cutting edges formed by replaceable bits used by motor graders or other similar equipment. More specifically, the present disclosure relates to tool bits that are low cost and that are attached to a blade assembly of a machine.

BACKGROUND

Machines such as motor graders employ a long blade that is used to level work surfaces during the grading phase of a construction project or the like. These blades often encounter abrasive material such as rocks, dirt, etc. that can degrade the working edge, making such blades ineffective for their intended purpose. Some blades have a serrated cutting edge meaning that the edge is not continuously flat but undulates up and down, forming teeth. A drawback to such blades is that the teeth may be more easily worn than is desired. In harsh environments, such blades may be rendered dull, with the teeth having been essentially removed, after 100-200 hours of operation. Necessitating their replacement. Serrated cutting edges are sometimes provided to improve penetration, etc.

Accordingly, devices have been developed that allow the teeth or bits that form the serrated cutting edges to be replaced. Typically, a moldboard extends downwardly from and is connected to the machine. An adapter board is attached to the to the moldboard and extends downwardly from the moldboard. So, the bottom free end of the adapter board is disposed adjacent the ground or other work surface. A plurality of bits are removably attached to the free end of the adapter board so that they may engage the ground or other work surface. These tool bits often have complicated geometry that is machined onto them after being forged. In some cases, an insert or tile made of a tougher or hardened material is placed at the tip of the tool bits to help promote the useful life of the tool bit. However, these types of tool bits may be more expensive than desirable.

Accordingly, there exists a need for providing a tool bit that is less expensive than heretofore devised.

SUMMARY OF THE DISCLOSURE

A blade assembly for use with a grading machine according to an embodiment of the present disclosure is provided. The blade assembly may comprise an adapter board defining an upper adapter board attachment portion, terminating in an upper adapter board free end, and a lower tool bit attachment portion, terminating in a lower adapter board free end, the lower tool bit attachment portion defining a width, and a plurality of tool bits configured to be attached to the adapter board, each tool bit including a shank portion defining a longitudinal axis, and a working portion, wherein the working portion defines a cylindrical profile about the longitudinal axis and a flat bottom surface.

A tool bit for use with a blade assembly of a grading machine according to an embodiment of the present disclosure is provided. The tool bit may comprise a shank portion including a cylindrical configuration defining a longitudinal axis, radial direction, and circumferential direction, and a working portion including a cylindrical configuration that is concentric with the shank portion and a flat bottom surface.

A tool bit for use with a blade assembly of a grading machine according to an embodiment of the present disclosure is provided. The tool bit may comprise a shank portion including a cylindrical configuration defining a longitudinal axis, a free end, a radial direction, and a circumferential direction, and a working portion including a cylindrical configuration that is concentric with the shank portion and a flat bottom surface. The shank portion includes at least one flat surface extending to the free end and further defining a cross-hole extending through the shank portion and the at least one flat surface.

BRIEF DESCRIPTION OF THE DRAWINGS

FIG. 5 is a bottom oriented perspective view of a second embodiment of the present disclosure showing a tool bit with a cylindrical profile similar to that of FIG. 4 except that a longitudinal bore is situated along the cylindrical axis of the tool bit for receiving an insert or the like.

FIG. 6 is a bottom oriented perspective view of a third embodiment of the present disclosure showing a tool bit with a cylindrical profile similar to that of FIG. 4 except that transverse slots extend through the lower working portion of the tool bit for receiving an insert or the like.

DETAILED DESCRIPTION

Figure 1:
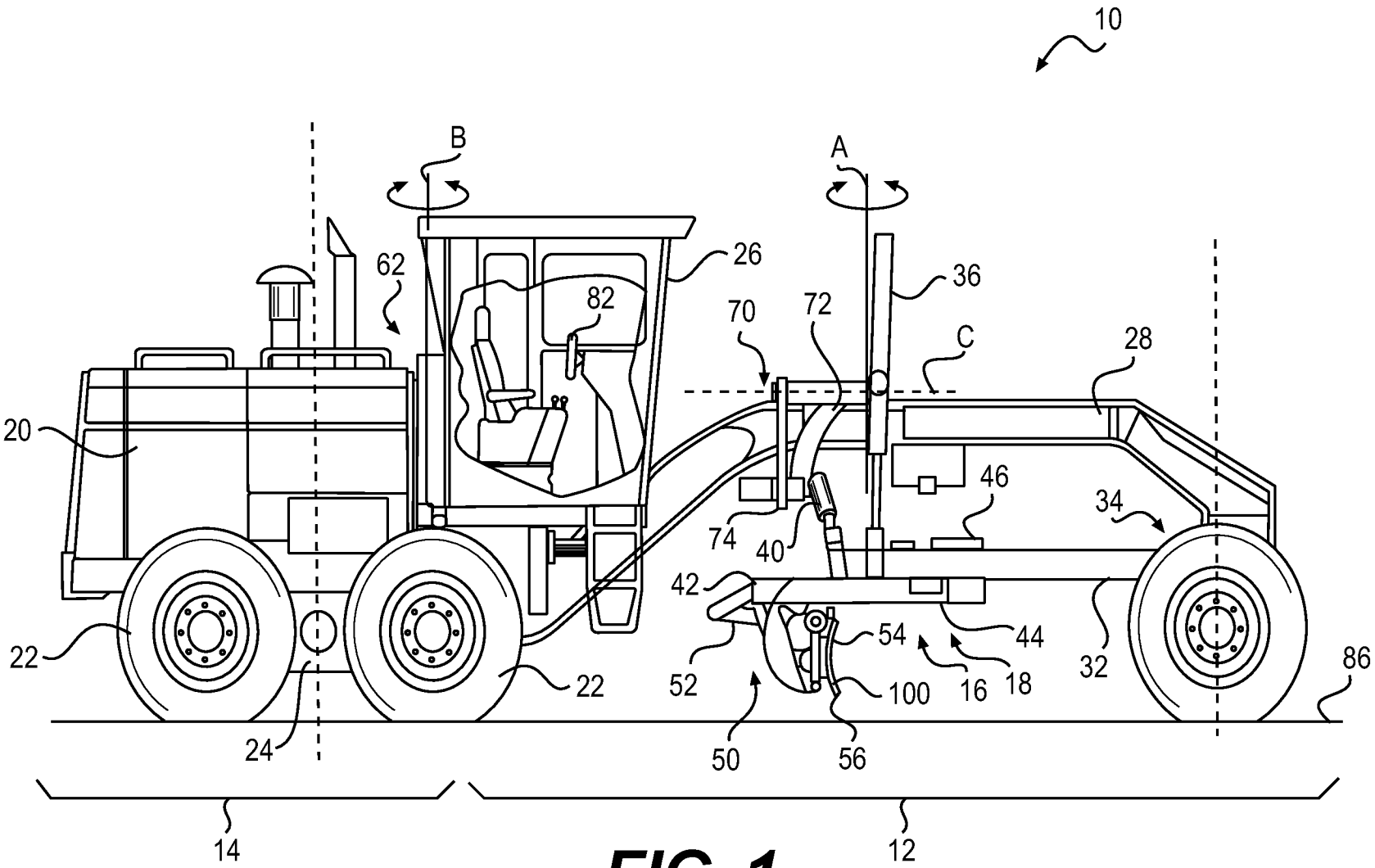
FIG. 1 is a side view of a motor grader that may employ a blade assembly and/or a tool bit according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

A blade assembly using tool bits with cylindrical configurations according to an embodiment of the present disclosure will be described. Then, a tool bit with a cylindrical configuration will be discussed.

First, a machine will now be described to give the reader the proper context for understanding how various embodiments of the present disclosure are used to level or grade a work surface. It is to be understood that this description is given as exemplary and not in any limiting sense. Any embodiment of an apparatus or method described herein may be used in conjunction with any suitable machine.

FIG. 1 is a side view of a motor grader in accordance with one embodiment of the present disclosure. The motor grader 10 includes a front frame 12, rear frame 14, and a work implement 16, e.g., a blade assembly 18, also referred to as a drawbar-circle-moldboard assembly (DCM). The rear frame 14 includes a power source (not shown), contained within a rear compartment 20, that is operatively coupled through a transmission (not shown) to rear traction devices or wheels 22 for primary machine propulsion.

As shown, the rear wheels 22 are operatively supported on tandems 24 which are pivotally connected to the machine between the rear wheels 22 on each side of the motor grader 10. The power source may be, for example, a diesel engine, a gasoline engine, a natural gas engine, or any other engine known in the art. The power source may also be an electric motor linked to a fuel cell, capacitive storage device, battery, or another source of power known in the art. The transmission may be a mechanical transmission, hydraulic transmission, or any other transmission type known in the art. The transmission may be operable to produce multiple output speed ratios (or a continuously variable speed ratio) between the power source and driven traction devices.

The front frame 12 supports an operator station 26 that contains operator controls 82, along with a variety of displays or indicators used to convey information to the operator, for primary operation of the motor grader 10. The front frame 12 also includes a beam 28 that supports the blade assembly 18 and which is employed to move the blade assembly 100 to a wide range of positions relative to the motor grader 10. The blade assembly 18 includes a drawbar 32 pivotally mounted to a first end 34 of the beam 28 via a ball joint (not shown). The position of the drawbar 32 is controlled by three hydraulic cylinders: a right lift cylinder 36 and left lift cylinder (not shown) that control vertical movement, and a center shift cylinder 40 that controls horizontal movement. The right and left lift cylinders are connected to a coupling 70 that includes lift arms 72 pivotally connected to the beam 28 for rotation about axis C. A bottom portion of the coupling 70 has an adjustable length horizontal member 74 that is connected to the center shift cylinder 40.

The drawbar 32 includes a large, flat plate, commonly referred to as a yoke plate 42. Beneath the yoke plate 42 is a circular gear arrangement and mount, commonly referred to as the circle 44. The circle 44 is rotated by, for example, a hydraulic motor referred to as the circle drive 46. Rotation of the circle 44 by the circle drive 46 rotates the attached blade assembly 100 about an axis A perpendicular to a plane of the drawbar yoke plate 42. The blade cutting angle is defined as the angle of the blade assembly 100 relative to a longitudinal axis of the front frame 12. For example, at a zero degree blade cutting angle, the blade assembly 100 is aligned at a right angle to the longitudinal axis of the front frame 12 and beam 28.

The blade assembly 100 is also mounted to the circle 44 via a pivot assembly 50 that allows for tilting of the blade assembly 100 relative to the circle 44. A blade tip cylinder 52 is used to tilt the blade assembly 100 forward or rearward. In other words, the blade tip cylinder 52 is used to tip or tilt a top edge 54 relative to the bottom cutting edge 56 of the blade 30, which is commonly referred to as blade tip. The blade assembly 100 is also mounted to a sliding joint associated with the circle 44 that allows the blade assembly 100 to be slid or shifted from side-to-side relative to the circle 44. The side-to-side shift is commonly referred to as blade side shift. A side shift cylinder (not shown) is used to control the blade side shift. The placement of the blade assembly 100 allows a work surface 86 such as soil, dirt, rocks, etc. to be leveled or graded as desired. The motor grader 10 includes an articulation joint 62 that pivotally connects front frame 12 and rear frame 14, allowing for complex movement of the motor grader, and the blade.

U.S. Pat. No. 8,490,711 to Polumati illustrates another motor grader with fewer axes of movement than that just described with respect to FIG. 1. It is contemplated that such a motor grader could also employ a blade according to various embodiments of the present disclosure, etc. Other machines other than graders may use various embodiments of the present disclosure as well.

Figure 2:
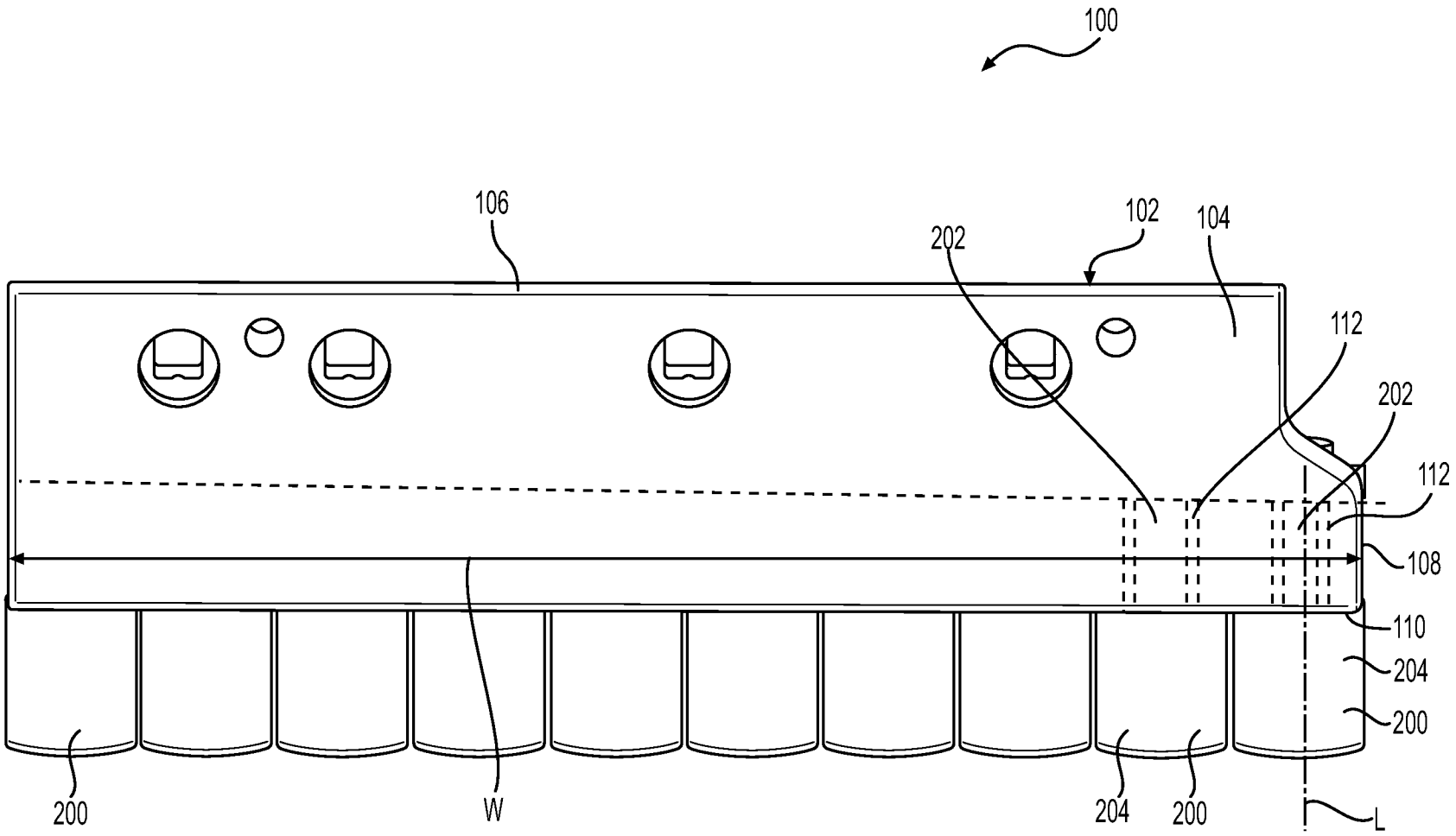
FIG. 2 is a front oriented perspective view of a blade assembly according to an embodiment of the present disclosure utilizing a tool bit with a cylindrical profile shown in isolation from the machine of FIG. 1.
Figure 3:
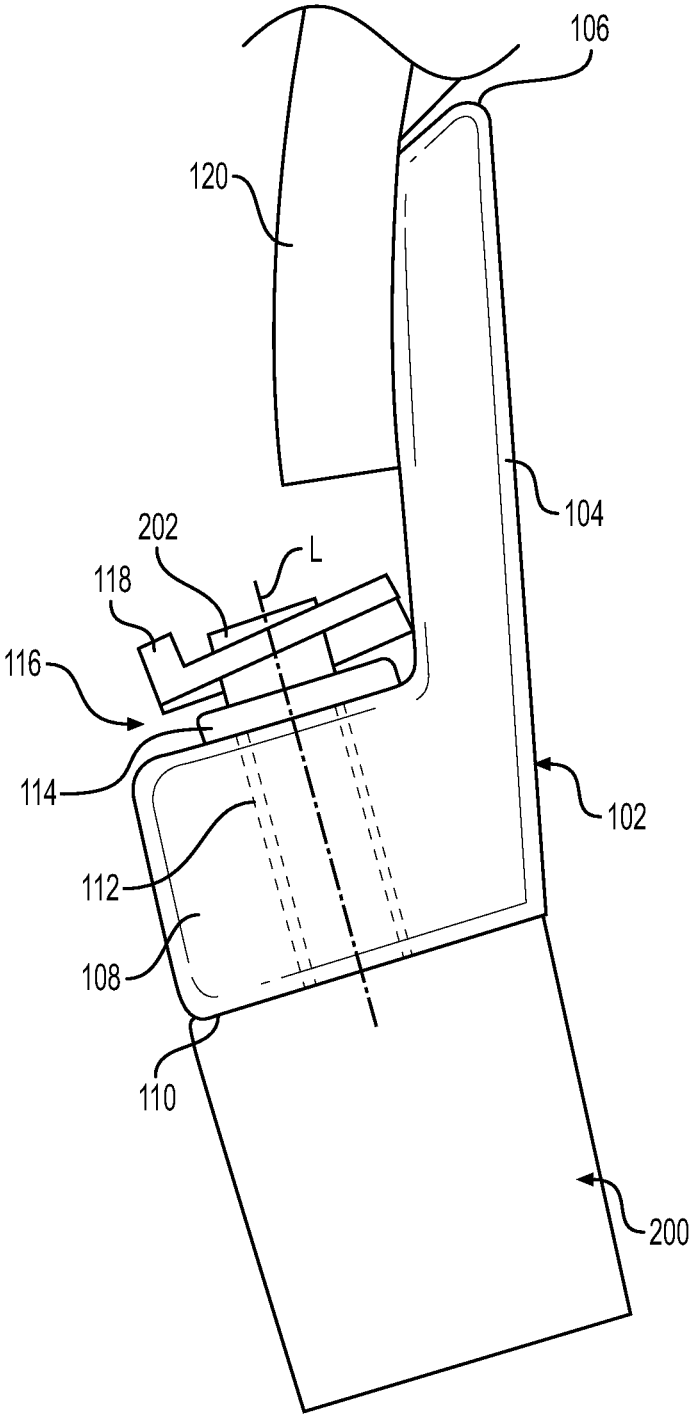
FIG. 3 is a side view of the blade assembly of FIG. 2 showing the mounting hardware securing the tool bit to the adapter board and the adapter board secured to a moldboard.
Figure 4:
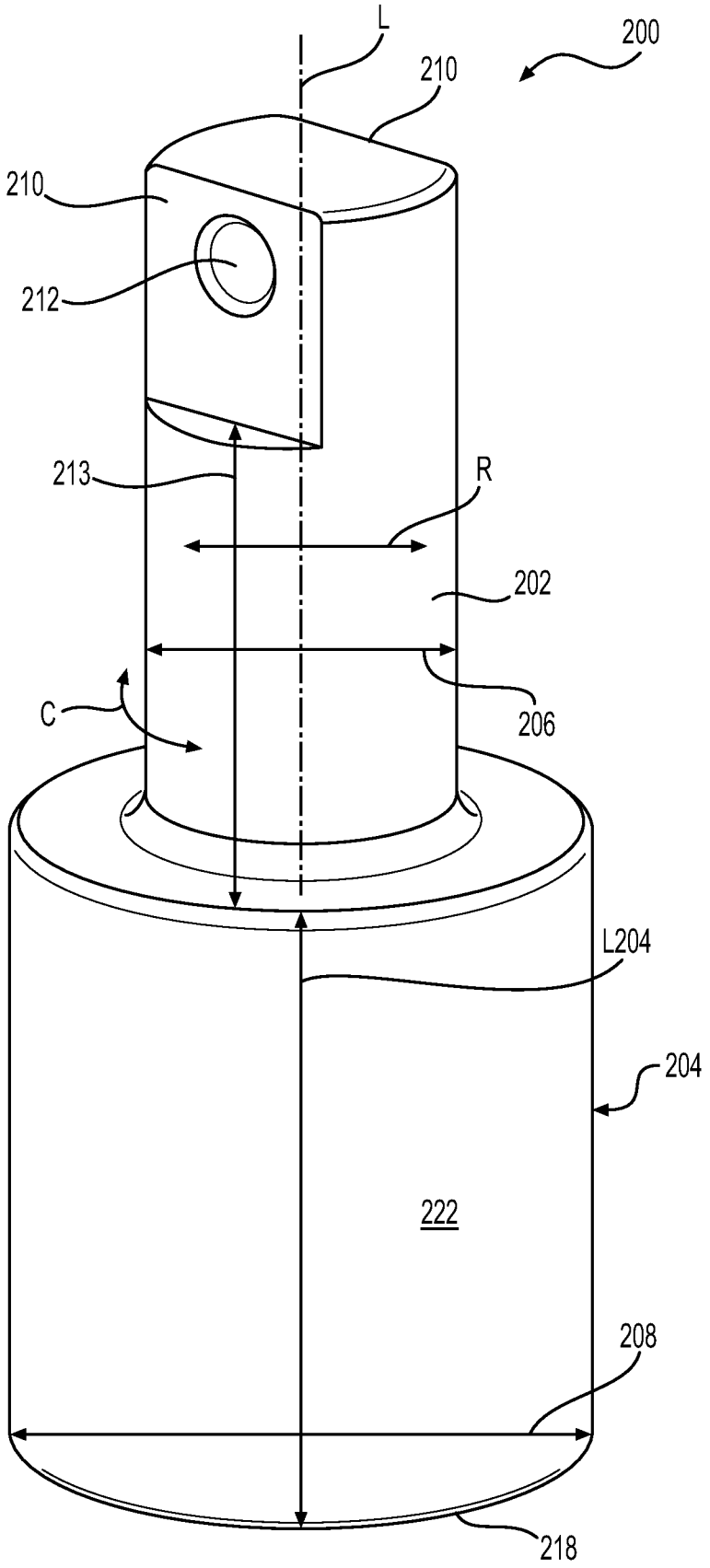
FIG. 4 is a top oriented perspective view of a first embodiment of the present disclosure showing a tool bit with a cylindrical profile may be used in conjunction with the blade assembly of FIG. 2.

Turning now to FIGS. 2 thru 4, a blade assembly 100 for use with a grading machine 10 according to an embodiment of the present disclosure will be described. The blade assembly 100 may comprise an adapter board 102 defining an upper adapter board attachment portion 104, terminating in an upper adapter board free end 106, and a lower tool bit attachment portion 108, terminating in a lower adapter board free end 110. The lower tool bit attachment portion 108 defines a width W. The blade assembly 100 further comprises a plurality of tool bits 200 configured to be attached to the adapter board 102, each tool bit 200 including a shank portion 202 defining a longitudinal axis L, and a working portion 204, wherein the working portion 204 defines a cylindrical profile about the longitudinal axis L and a flat bottom surface 218.

The lower tool bit attachment portion 108 of the adapter board 102 may define a plurality of cylindrical thru-bores 112 and the shank portion 202 of the tool bit 200 may include a cylindrical configuration defining a circumferential direction C and a radial direction R, the shank portion 202 being configured to fit within one of the plurality of cylindrical thru-bores 112. As best seen in FIG. 3, the shank portion 202 may extend completely through the lower tool bit attachment portion 108 and may be rotatably fixed relative to the lower tool bit attachment portion 108 of the adapter board 102 via an orientation plate 114 that may sit on top of the lower tool bit attachment portion 108 and may engage the flats 210 of the shank portion 102 (e.g. the orientation plate 114 may have a complimentarily shaped aperture through which the shank portion 202 extends, preventing rotation circumferentially as the orientation plate 114 abuts the upper adapter board attachment portion 104). Mounting hardware 116 including a pin 118 may prevent movement of the tool bit 200 along the longitudinal axis L. A moldboard 120 is also shown to which the adapter board 102 may be attached via bolts or the like, welding, etc.

Focusing on FIG. 4, the shank portion 202 may define a first diameter 206 and the working portion 204 may define a second diameter 208 that is greater than the first diameter 206. Also, the shank portion 202 may define two flat surfaces 210, the two flat surfaces 210 at least partially defining a cross-hole 212 extending radially thru the shank portion 202. The two flat surfaces 210 are spaced axially away from the working portion 204 a predetermined amount 213 and that amount 213 may range from 15 to 40 mm. Similarly, the first diameter 206 of the shank portion 202 may range from 20 to 45 mm and the second diameter 208 of the working portion 204 may range from 15 to 65 mm.

Figure 5:
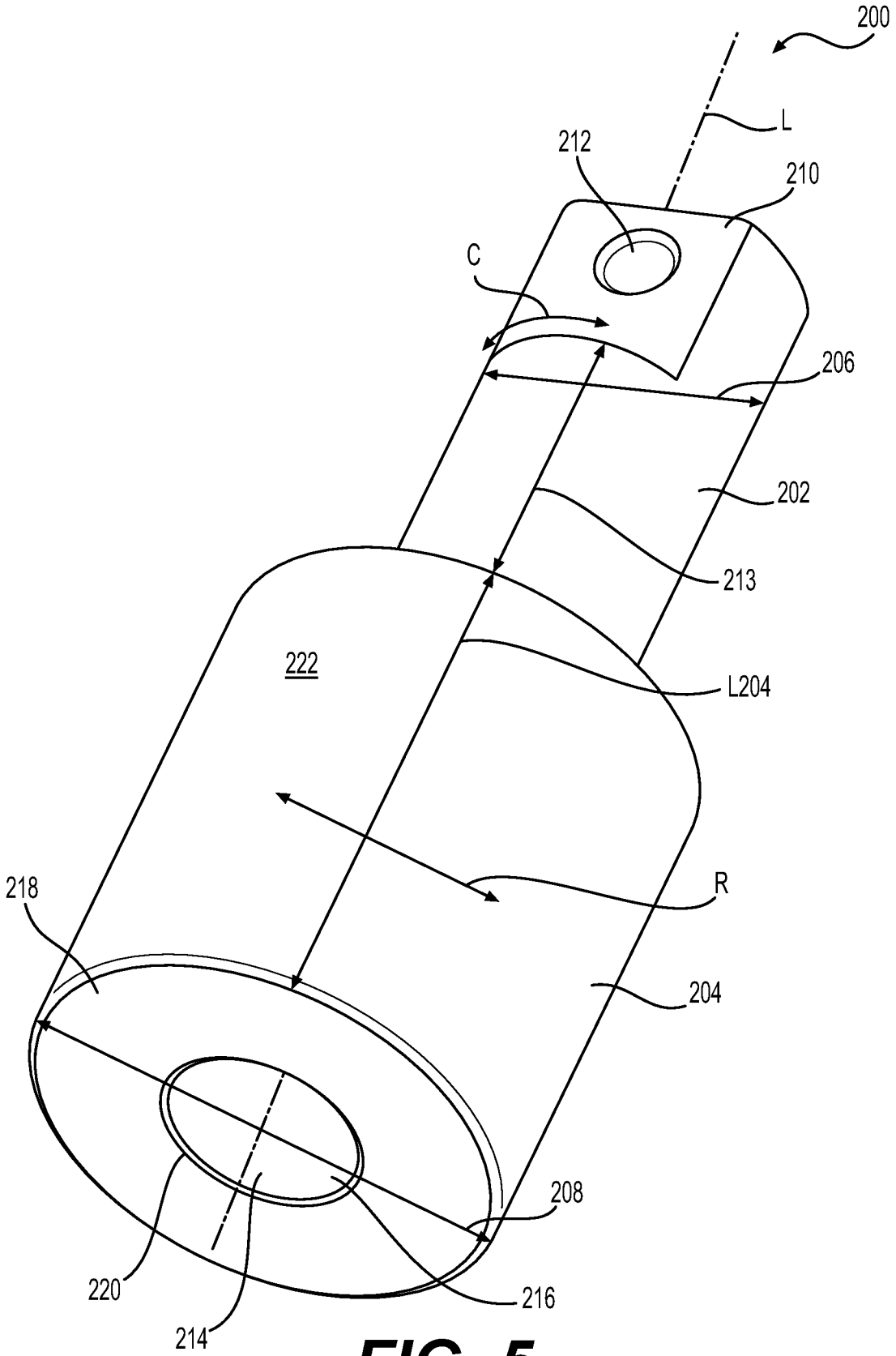
Figure 6:
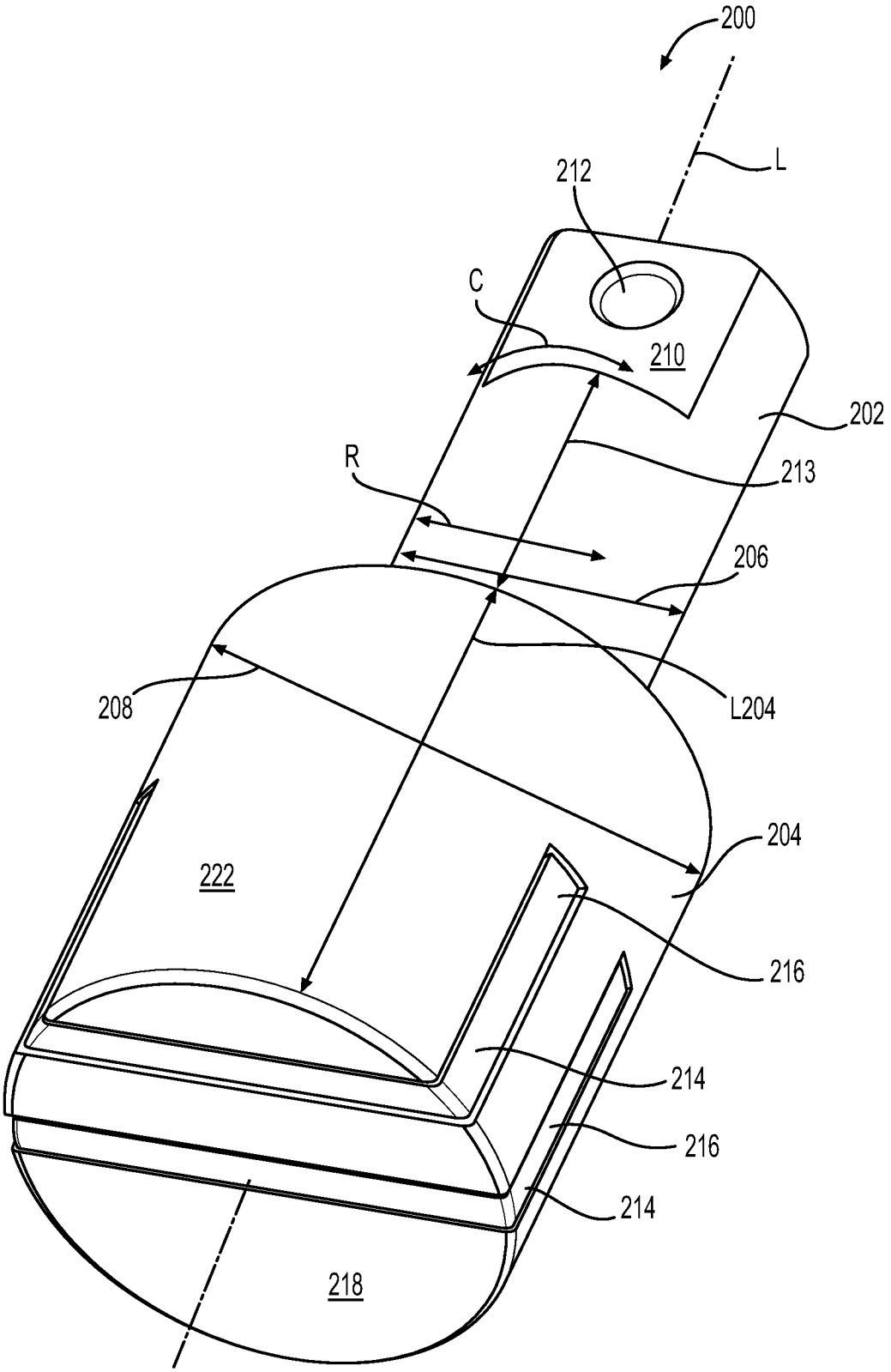
Figure 7:
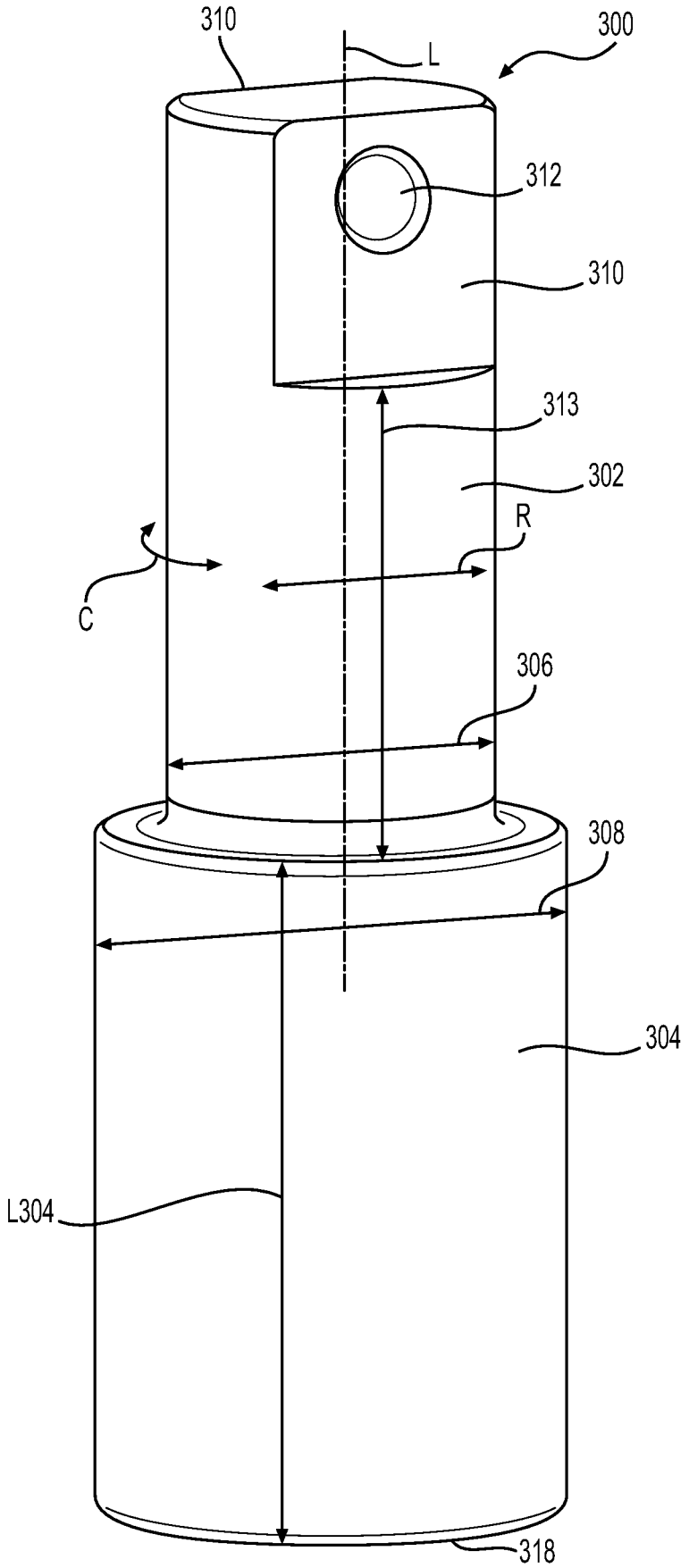
FIG. 7 is a perspective view of a fourth embodiment of a tool bit where the diameter of the working portion is smaller than that of the embodiment of FIG. 3.
Figure 8:
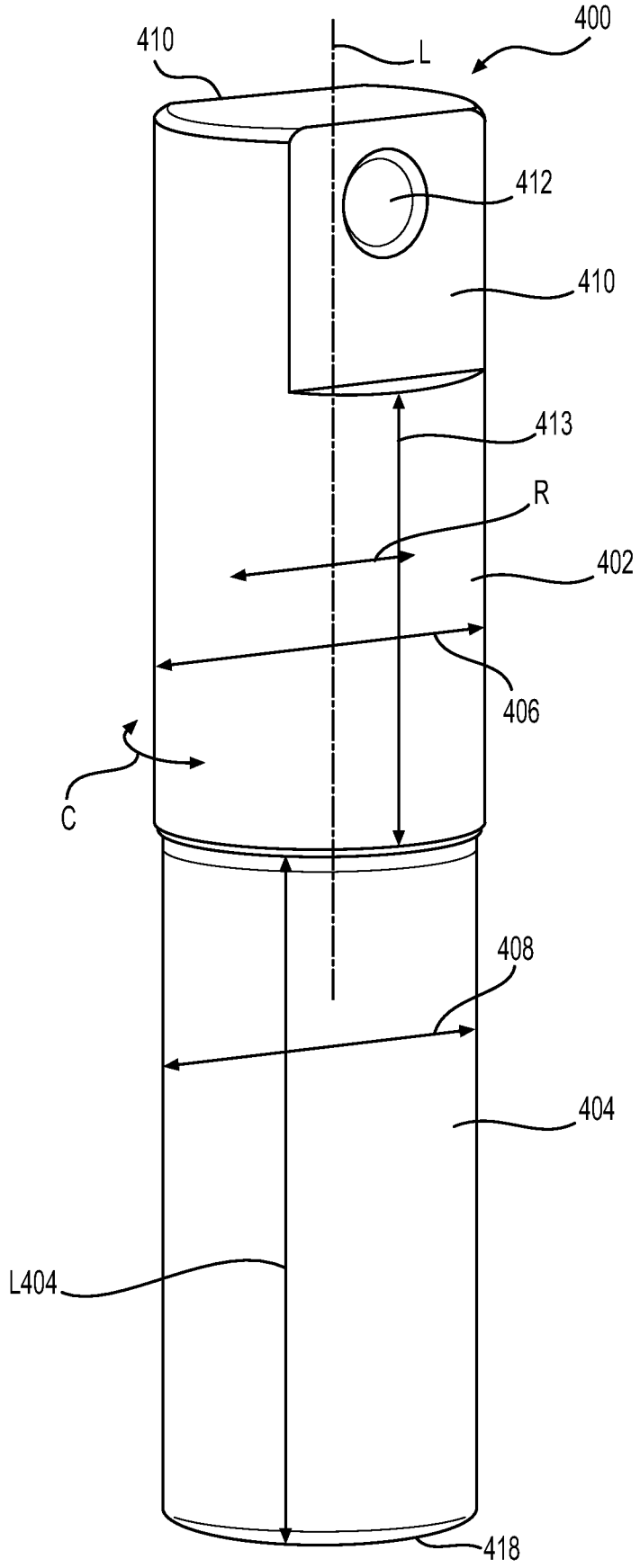
FIG. 8 is a perspective view of a fifth embodiment of a tool bit where the diameter of the working portion is smaller than the diameter of the shank portion.

In many embodiments as shown in FIGS. 4 thru 6, the working portion 204 may be concentric with the shank portion 202, allowing the tool bit 200 to be turned on a lathe or similar apparatus. The working portion 204 may define a longitudinal length L204 ranging from 30 to 90 mm. Furthermore, the working portion 204 defines an aperture 214 configured to receive an insert 216. For example, the working portion may define a bottom surface 218 that defines a cylindrical bore 220, centered about the longitudinal axis L. Alternatively, the working portion 204 may include a circumferential surface 222 and the aperture 214 may extend through the circumferential surface 222, and completely through the working portion 204 as shown or may be blind. A plurality of apertures 214 may be provided one of which may be pass through the center or longitudinal axis L of the working portion 204 while the other is distance radially away from the aperture 214 passing through the center or longitudinal axis.

A tool bit 200, 300, 400, 500 for use with a blade assembly of a grading machine 10 will now be described with reference to FIGS. 4 thru 10. A tool bit 200, 300, 400, 500 may comprise a shank portion 202, 302, 402, 502 including a cylindrical configuration defining a longitudinal axis L, radial direction R, and circumferential direction C. A working portion 204, 304, 404, 504 including a cylindrical configuration that is concentric with the shank portion 202, 302, 402, 502 with a flat bottom surface 218, 318, 418, 518 is provided. The shank portion 202, 302, 402, 502 may be configured to be attached to the blade assembly 100 in a rotatably fixed manner as previously described and the working portion 204, 304, 404, 504. For the embodiments shown in FIGS. 3 thru 6, 8 and 9, the shank portion 202, 302, 502 defines a first diameter 206, 306, 506 and the working portion 204, 304, 504, defines a second diameter 208, 308, 508 that is greater than the first diameter 206, 306, 506. For the embodiment shown in FIG. 7, the second diameter 408 may be smaller than the first diameter 406.

As alluded to earlier, the shank portion 202, 302, 402, 502 defines two flat surfaces 210, 310, 410, 510, the two flat surfaces 210, 310, 410, 510 defining a cross-hole 212, 312, 412, 512 extending radially thru the shank portion 202, 302, 402, 502. The two flat surfaces 210, 310, 410, 510 are spaced axially away from the working portion 204 a predetermined amount 213, 313, 413, 513. The predetermined amount 213, 313, 413, 513 may range from 30 to 60 mm.

In some embodiments, the first diameter 206, 306, 406, 506 may range from 20 to 45 mm and the second diameter 208, 308, 408, 508 may range from 15 to 65 mm. Similarly, the working portion 204, 304, 404, 504 may define a longitudinal length L204, L304, L404, L504 ranging from 30 to 90 mm.

Referring now to FIGS. 5 and 6, the working portion 204 may define an aperture 214 configured to receive an insert 216, which is made of a durable or tough material such as Tungsten Carbide or the like. In FIG. 5, the flat bottom surface 218 defines the aperture 214, which is to say, the aperture 214 (e.g. a cylindrical hole) is disposed on the flat bottom surface 218 and is centered about the longitudinal axis L. In FIG. 6, the circumferential surface 222 defines the aperture 214, that is to say, the aperture 214 is disposed on the circumferential surface 222. The aperture in 214 may extend in a direction parallel to the flat surface 210.

Figure 9:
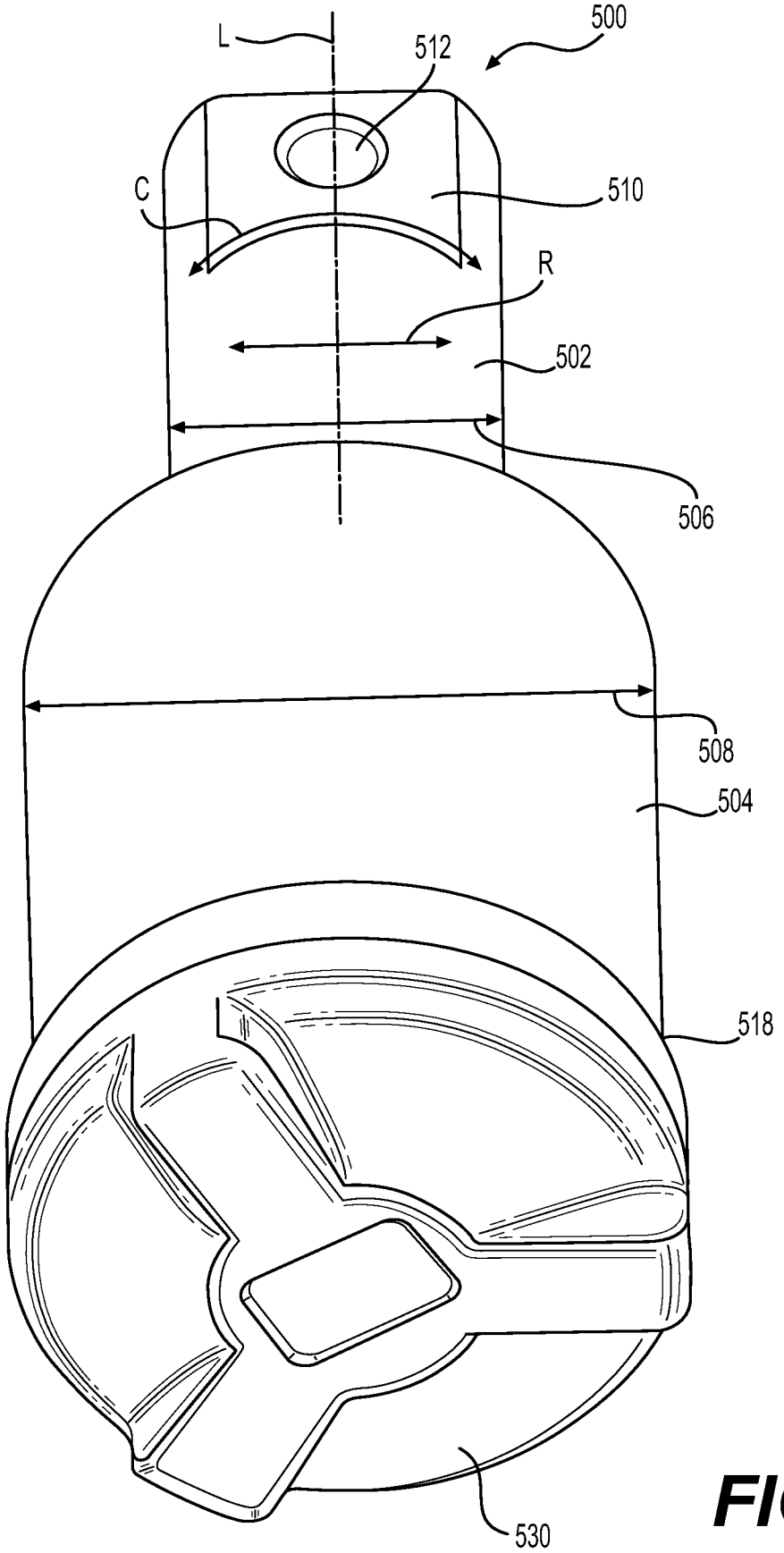
FIG. 9 is a bottom oriented perspective view of a sixth embodiment where a wear button is attached onto the bottom of the tool bit.
Figure 10:
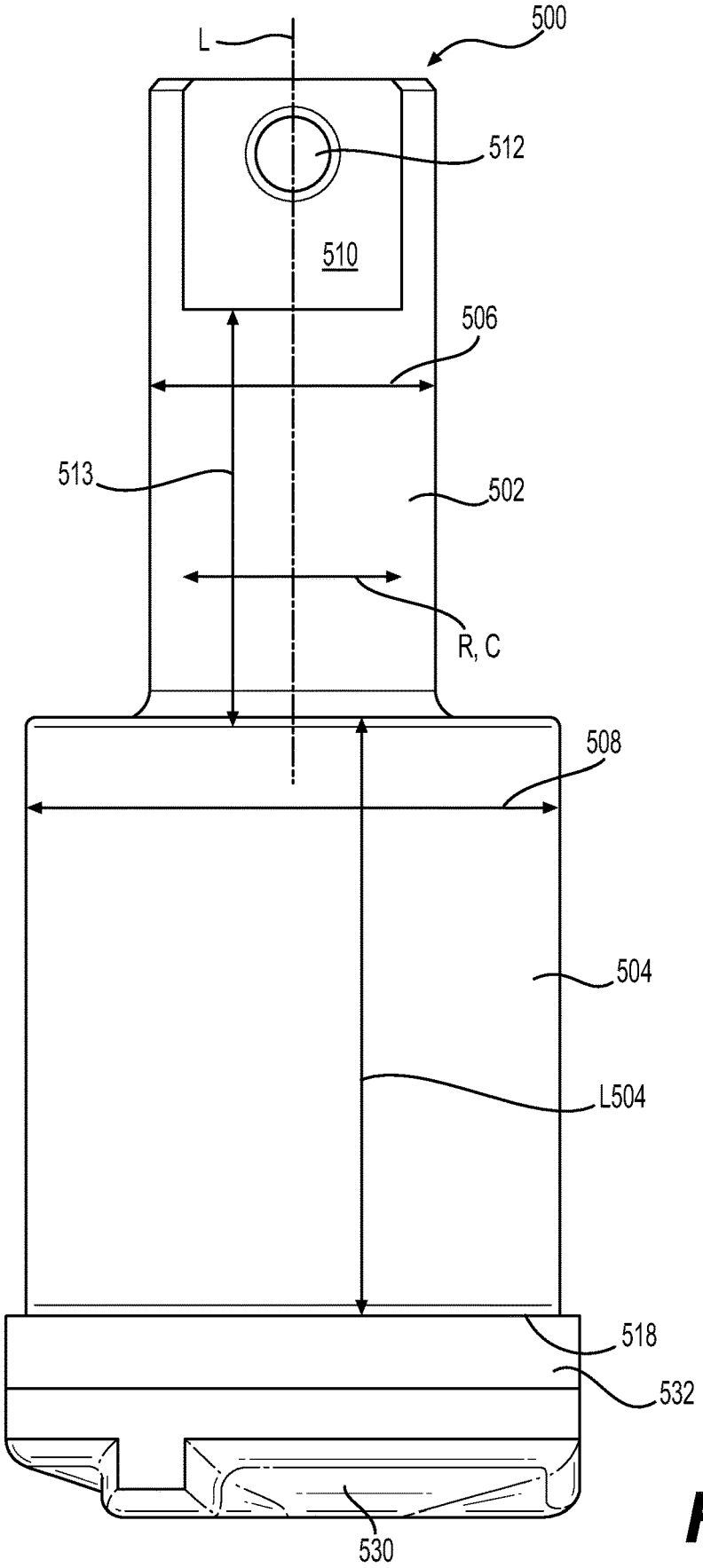
FIG. 10 is a front view of the tool bit with a wear button of FIG. 8.

FIGS. 9 and 10 show that a wear button 530 may be attached to the flat bottom surface 518. More specifically, a plate 532 may be attached to the working portion 504 (e.g. at the bottom surface 518), while the wear button 530 may be attached to the plate 532 via welding.

It should be noted that any of the dimensions, angles, surface areas and/or configurations of various features may be varied as desired or needed including those not specifically mentioned herein. Although not specifically discussed, blends such as fillets are shown in FIGS. 3 thru 6 to connect the various surfaces. These may be omitted in other embodiments and it is to be understood that their presence may be ignored when reading the present specification.

INDUSTRIAL APPLICABILITY

In practice, a machine, a blade assembly, and/or a tool bit may be manufactured, bought, or sold to retrofit a machine or blade assembly in the field in an aftermarket context, or alternatively, may be manufactured, bought, sold or otherwise obtained in an OEM (original equipment manufacturer) context.

The tool bit may manufactured turning bar stock on a lathe, reducing cost.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A blade assembly for use with a grading machine, the blade assembly comprising:

an adapter board defining an upper adapter board attachment portion, terminating in an upper adapter board free end, and a lower tool bit attachment portion, terminating in a lower adapter board free end, the lower tool bit attachment portion defining a width; and a plurality of tool bits configured to be attached to the adapter board, each tool bit including a shank portion defining a longitudinal axis; and a working portion, wherein the working portion defines a cylindrical profile about the longitudinal axis, a flat bottom surface, and a longitudinal length;

wherein the cylindrical profile constitutes a continuous cylindrical surface that extends longitudinally between the shank portion and the flat bottom surface a majority of the longitudinal length, the shank portion defines two flat surfaces, and a cross-hole extending radially thru the shank portion and the two flat surfaces, and wherein each tool bit further comprises a wear button that is attached to a plate, and the plate is welded to the working portion.

2. The blade assembly of claim 1 wherein the lower tool bit attachment portion of the adapter board defines a plurality of cylindrical thru-bores and the shank portion of the tool bit includes a cylindrical configuration defining a circumferential direction and a radial direction, the shank portion being configured to fit within one of the plurality of cylindrical thru-bores and extend completely through the lower tool bit attachment portion, the shank portion being rotatably fixed relative to the lower tool bit attachment portion of the adapter board.

3. The blade assembly of claim 2 wherein the shank portion defines a first diameter and the working portion defines a second diameter that is greater than the first diameter.

4. The blade assembly of claim 3 wherein the first diameter ranges from 20 mm to 45 mm and the second diameter ranges from 15 mm to 65 mm.

5. The blade assembly of claim 1 wherein the two flat surfaces are spaced axially away from the working portion a predetermined amount.

6. The blade assembly of claim 5 wherein the predetermined amount ranges from 15 mm to 40 mm.

7. The blade assembly of claim 2 wherein the working portion is concentric with the shank portion.

8. The blade assembly of claim 1 wherein the working portion defines a longitudinal length ranging from 30 mm to 90 mm.

9. The blade assembly of claim 1 wherein the working portion defines an aperture configured to receive an insert to improve wear life.

10. A tool bit for use with a blade assembly of a grading machine, the tool bit comprising:

a shank portion including a shank cylindrical configuration defining a longitudinal axis, a radial direction, and a circumferential direction; and a working portion including a working portion cylindrical configuration that is concentric with the shank portion and a flat bottom surface, the working portion defining a longitudinal length;

wherein the working portion cylindrical configuration constitutes a single cylindrical surface that extends longitudinally from adjacent the shank portion toward the flat bottom surface the majority of the longitudinal length of the working portion, the flat bottom surface lacking an aperture, and wherein the tool bit further comprises a wear button that is attached to a plate, and the plate is welded to the working portion.

11. The tool bit of claim 10 wherein the shank portion is configured to be attached to the blade assembly in rotatably fixed manner, and the single cylindrical surface lacks an aperture.

12. The tool bit of claim 11, wherein the shank portion defines a first diameter and the working portion defines a second diameter that is greater than the first diameter.

13. The tool bit of claim 12 wherein the shank portion defines two flat surfaces, the two flat surfaces defining a cross-hole extending radially thru the shank portion.

14. The tool bit of claim 12 wherein the first diameter ranges from 20 mm to 45 mm, the second diameter ranges from 15 mm to 65 mm, and the working portion defines a longitudinal length ranging from 30 mm to 90 mm.

15. The tool bit of claim 13 wherein the two flat surfaces are spaced axially away from the working portion a predetermined amount that ranges from 15 mm to 40 mm.

16. A tool bit for use with a blade assembly of a grading machine, the tool bit comprising:

a shank portion including a cylindrical configuration defining a longitudinal axis, a free end, a radial direction, and a circumferential direction; and a working portion including a cylindrical configuration that is concentric with the shank portion and a flat bottom surface;

wherein the shank portion includes at least one flat surface extending to the free end and further defining a cross-hole extending through the shank portion and the at least one flat surface, and the shank portion is unitary with working portion, and wherein the tool bit further comprises a wear button that is attached to a plate, and the plate is welded to the working portion.

17. The tool bit of claim 16, wherein the working portion defines an aperture with an insert in the aperture that is flush with the flat bottom surface.

18. A tool bit for use with a blade assembly of a grading machine, the tool bit comprising:

a shank portion including a cylindrical configuration defining a longitudinal axis, a free end, a radial direction, and a circumferential direction;

a working portion including a cylindrical configuration that is concentric with the shank portion and a bottom surface;

a plate that is attached to the bottom surface; and a wear button that is attached to the plate;

wherein the shank portion includes at least one flat surface extending to the free end and further defining a cross-hole extending through the shank portion and the at least one flat surface, and the shank portion is unitary with working portion.

* * * * *